US008720315B2

(12) United States Patent
Liu et al.

(10) Patent No.: US 8,720,315 B2
(45) Date of Patent: May 13, 2014

(54) COMBUSTION GAS PISTON TYPE MOVABLE GUIDING TUBE NETTING DEVICE

(71) Applicant: Beijing Mechanical Equipment Institute, Beijing (CN)

(72) Inventors: Hao Liu, Beijing (CN); Shuyong Han, Beijing (CN); Shengjie Wang, Beijing (CN); Xuyang Qiu, Beijing (CN); Aifeng Chen, Beijing (CN); Yulong Tang, Beijing (CN); Kegang Chi, Beijing (CN); Hejiu Wang, Beijing (CN); Chengshuai Su, Beijing (CN)

(73) Assignee: Beijing Mechanical Equipment Institute, Beijing (CN)

( * ) Notice: Subject to any disclaimer, the term of this patent is extended or adjusted under 35 U.S.C. 154(b) by 0 days.

(21) Appl. No.: 14/010,511

(22) Filed: Aug. 26, 2013

(65) Prior Publication Data

US 2013/0340600 A1 Dec. 26, 2013

Related U.S. Application Data

(63) Continuation of application No. PCT/CN2011/076669, filed on Jun. 30, 2011.

(51) Int. Cl.
*F41H 5/007* (2006.01)

(52) U.S. Cl.
CPC ..... *F41H 5/007* (2013.01)
USPC ..... 89/36.17; 89/902

(58) Field of Classification Search
CPC ..... F41H 5/007
USPC ..... 102/504; 89/36.17, 1.34, 902
See application file for complete search history.

(56) References Cited

U.S. PATENT DOCUMENTS

| | | | | |
|---|---|---|---|---|
| 5,460,155 | A * | 10/1995 | Hobbs, II | 124/56 |
| 7,866,250 | B2 * | 1/2011 | Farinella et al. | 89/36.17 |
| 2007/0180983 | A1 * | 8/2007 | Farinella et al. | 89/36.07 |

FOREIGN PATENT DOCUMENTS

| | | | |
|---|---|---|---|
| CN | 2116357 | U | 9/1992 |
| CN | 1877244 | A | 12/2006 |
| CN | 101517351 | A | 8/2009 |
| CN | 201327358 | Y | 10/2009 |

* cited by examiner

*Primary Examiner* — Stephen M Johnson
(74) *Attorney, Agent, or Firm* — Syncoda LLC; Feng Ma

(57) ABSTRACT

A combustion gas piston type movable guiding tube netting device includes a capture net (8), a traction head (6), a guiding tube (7), an igniter (3), a main gunpowder (5), a combustion gas generator (1) and a piston (2). The piston and the main gunpowder are placed in the combustion gas generator. The top of the piston contacts a triangular lug on the base of the guiding tube. The traction head is placed in the guiding tube, and another end of the traction head is tied on one corner of the capture net. When operating, the main gunpowder is ignited by the igniter, the resulting combustion gas pushes the piston to move, the piston pushes the guiding tube to move, and the combustion gas comes into the guiding tube and pushes the traction head to burst out the guiding tube, and the traction head drives the capture net to open. The combustion gas piston type movable guiding tube netting device has a quick expansion speed, and the area of the expansive capture net is big.

1 Claim, 4 Drawing Sheets

COMBUSTION GAS PISTON TYPE MOVABLE GUIDING TUBE NETTING DEVICE

CROSS-REFERENCE TO RELATED APPLICATIONS

The present application is a continuation of PCT/CN2011/076669, filed Jun. 30, 2011, the disclosure of which hereby incorporated by reference in its entirety.

BACKGROUND

The present invention relates to a netting device, more particularly to a combustion gas piston type movable guiding tube netting device.

The current developed capture net system at home and abroad mainly is "net gun" for police. A netting device of a "net gun" mainly consists of: a firing mechanism, a high-pressure gas cylinder, a fixed guiding tube, a traction head and a capture net. Such netting device employs the power generated by the high-pressure gas cylinder to push the traction head to accelerate along a fixed pipe with a certain angle, each traction head drives one corner of the capture net and bring out the net, thereby achieving the capture net's open. The disadvantage of the netting device of the "net gun" is that the accelerating tube has a small angle and a short travel, thus the area of the capture net to be opened is small. If the angle and the travel of the accelerating tube are increased, the dimension of the netting device will be increased.

SUMMARY

The present invention is aimed to provide a combustion gas piston type movable guiding tube netting device, to solve the problem for a contradiction between the increased open net area and the reduced dimension of the current netting device.

A combustion gas piston type movable guiding tube netting device comprises: a capture net, a traction head, a guiding tube; further comprises: an igniter, a main gunpowder, a sealing ring, a combustion gas generator, a piston and a cover plate, wherein the main gunpowder includes black powders and a power box, the combustion gas generator includes a chamber, a groove, an airway and a gas channel. The chamber is within the inside of the combustion gas generator and has a cylindrical shape, and the piston and the main gunpowder are placed within the chamber. The top of the piston contacts a triangular lug on the base of the guiding tube. The lower end of the combustion gas generator is threadly connected to the igniter. The grooves, that the number of which is four to six and the shape of which is semi-cylindrical, are uniformly distributed in the surface of the upper end of the combustion gas generator. The shape and number of the airways matches the shape and number of the grooves, respectively. A plurality of grooves and a plurality of airways are alternatively distributed and interconnected. The gas channel is communicated with the chamber and the airway at both ends thereof, and the number thereof is the same as the number of the airway. The bottom of the guiding tube has a '⊥' shape and is placed in the groove. The cover plate is closely fitted with the upper end of the combustion gas generator and the bottom of the guiding tube with the sealing ring in its interface surface. The cover plate is fixed on the upper end of the combustion gas generator with screws. The traction head is placed in the internal bottom of the guiding tube and pinned, and is fixed on one corner of the capture net at another end.

The gas generated by the combustion gas generator is the power source of the netting device to push the piston to move so that the guiding tube is rotated 40°-45°, and also to push the traction head to burst out of the guiding tube so that the capture net is smoothly opened. The guiding tube is vertically retracted in the initial state of the netting device. During operating, the ignition signal detonates the igniter, the resulting combustion gas pushes the piston to move upward to push the triangle lug on the base of the guiding tube so that the whole guiding tube is rotated. After the piston is moved a distance of 20-40 mm, the gas channel is opened, so that the gas comes into the guiding tube and pushes the traction head to move at high speed and fly out of the guiding tube, so that the traction head drives the capture net to open.

The device has a novel structure and a quick expansion speed, the accelerating tube has a long travel and a large angle, the area of the expansive capture net is big, and the dimensions thereof is small in the initial state.

Figure 1:
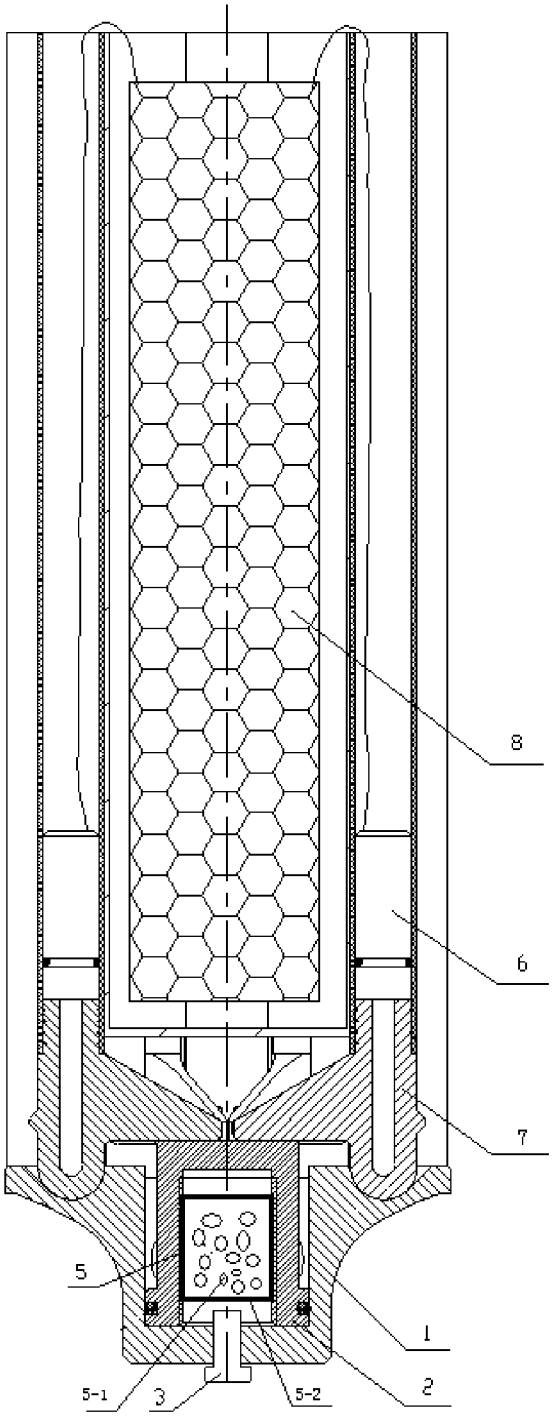
FIG. 1 is a structure diagram of a combustion gas piston type movable guiding tube netting device in an initial state.
Figure 2:
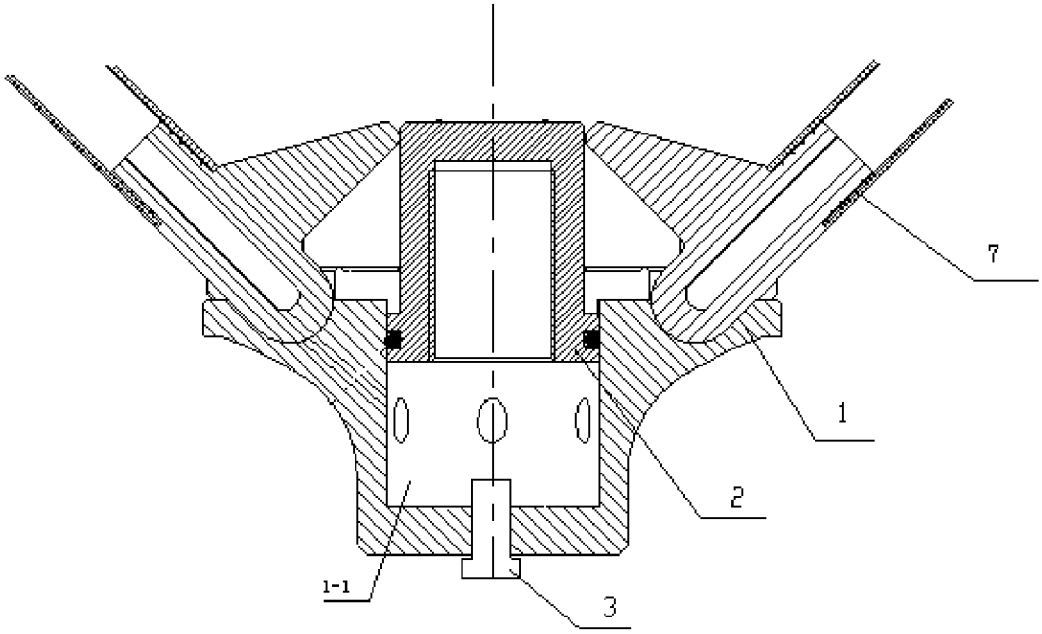
FIG. 2 is a structure diagram of a combustion gas piston type movable guiding tube netting device in an operating state.
Figure 3:
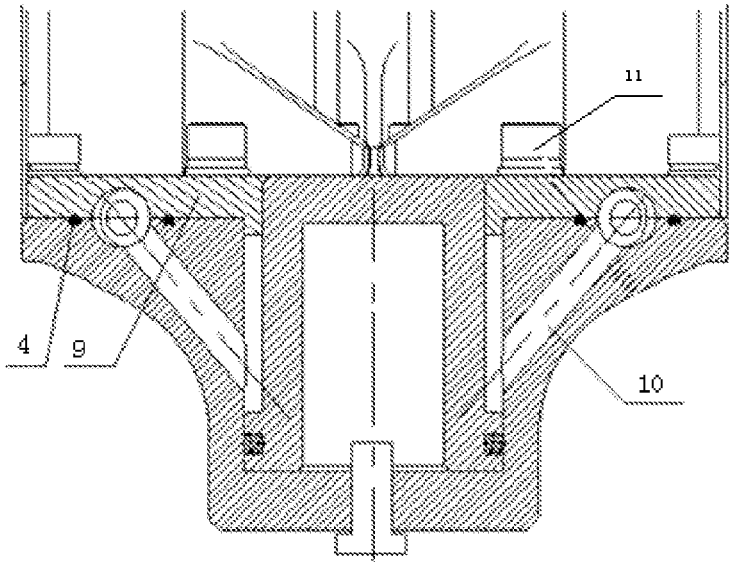
FIG. 3 is a structure diagram showing the fixed form of the guiding tube and the structure of the gas channel of a combustion gas piston type movable guiding tube netting device.
Figure 4:
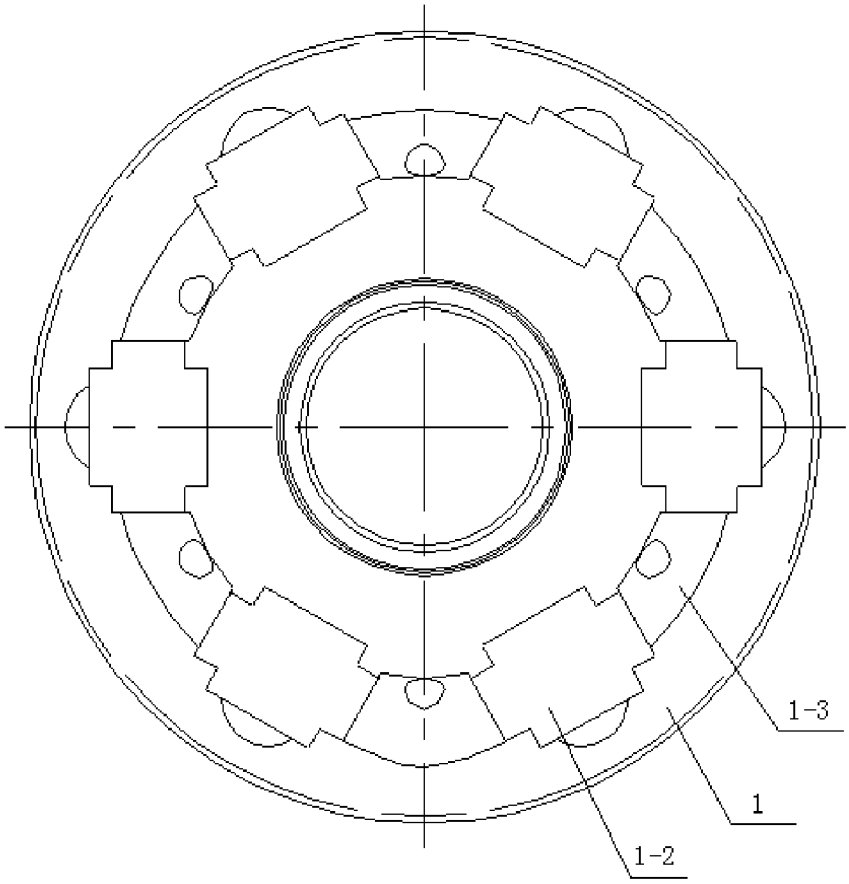
FIG. 4 is a diagram showing the structure of the gas channel of the combustion gas generator of a combustion gas piston type movable guiding tube netting device.
Figure 5:
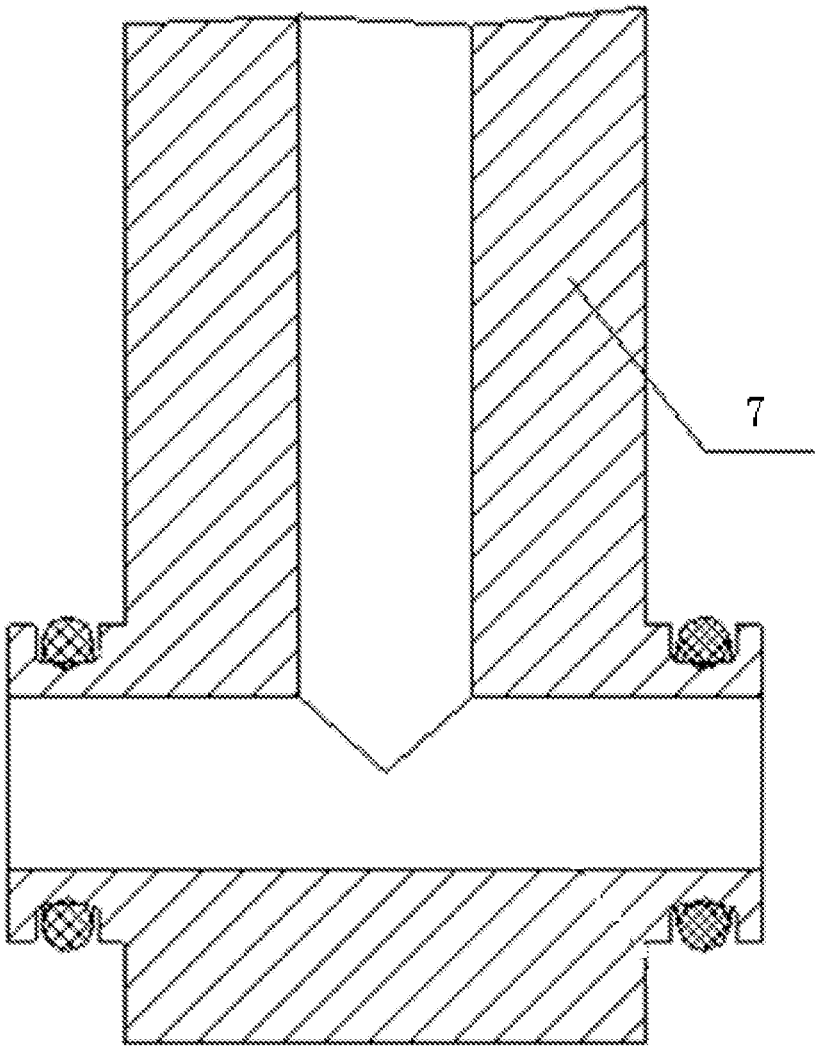
FIG. 5 is a sectional view of the base of the guiding tube of a combustion gas piston type movable guiding tube netting device.

1. Combustion gas generator; 2. Piston; 3. Igniter; 4. Sealing ring; 5. Main gunpowder; 6. Traction head; 7. Guiding tube; 8. Capture net; 9. Cover plate; 10. Gas channel

DETAILED DESCRIPTION

A combustion gas piston type movable guiding tube netting device comprises: a capture net 8, a traction head 6 and a guiding tube 7, and further comprises: an igniter 3, a main gunpowder 5, a sealing ring 4, a combustion gas generator 1, a piston 2 and a cover plate 9, wherein the main gunpowder 5 includes black powders and a power box, the combustion gas generator 1 includes a chamber, a groove, an airway and a gas channel 10. The chamber is within the inside of the combustion gas generator 1 and has a cylindrical shape, and the piston 2 and the main gunpowder 5 are placed within the chamber. The top of the piston 2 contacts a triangular lug on the base of the guiding tube 7. The lower end of the combustion gas generator 1 is threadly connected to the igniter 3. The grooves, the number of which is six and the shape of which is semi-cylindrical, are uniformly distributed in the surface of the upper end of the combustion gas generator 1, and the shape and number of the airways matches the shape and number of the grooves, respectively. Six grooves and six airways are alternatively distributed and interconnected. The gas channel 10 is communicated with the chamber and the airway at both ends thereof, and the number thereof is the same as the number of the airway. The bottom of the guiding tube 7 has a '⊥' shape and is placed in the groove. The cover plate 9 is closely fitted with the upper end of the combustion gas generator 1 and the bottom of the guiding tube 7 with the sealing ring 4 in its interface surface. The cover plate 9 is fixed on the upper end of the combustion gas generator 1 with screws. The traction head 6 is placed in the internal bottom end of the guiding tube 7 and is pinned, and is fixed on one corner of the capture net 8 at another end.

The gas generated by the combustion gas generator 1 is the power source of the netting device to push the piston 2 to move so that the guiding tube 7 is rotated 45°, and also to push the traction head 6 to launch outside the guiding tube 7 so that the capture net 8 is smoothly opened. The guiding tube 7 is vertically retracted in the initial state of the netting device. During operating, the ignition signal detonate the igniter 3, the resulting combustion gas pushes the piston 2 to move upward to push the triangle lug on the base of the guiding tube 7, so that the whole guiding tube 7 is rotated. After the piston 2 is moved a distance of 30 mm, the gas channel 10 is opened, so that the gas comes into the guiding tube 7 and pushes the traction head 6 to move at high speed and fly out of the guiding tube 7, so that the traction head 6 drives the capture net 8 to open.

A combustion gas piston type movable guiding tube netting device comprises: a capture net 8, a traction head 6 and a guiding tube 7, and further comprises: an igniter 3, a main gunpowder 5, a sealing ring 4, a combustion gas generator 1, a piston 2 and a cover plate 9, wherein the main gunpowder 5 includes black powders and a power box, the combustion gas generator 1 includes a chamber, a groove, an airway and a gas channel 10. The chamber is within the inside of the combustion gas generator 1 and has a cylindrical shape, and the piston 2 and the main gunpowder 5 are placed within the chamber. The top of the piston 2 contacts a triangular lug on the base of the guiding tube 7. The lower end of the combustion gas generator 1 is threadly connected to the igniter 3. The grooves, the number of which is six and the shape of which is semi-cylindrical, are uniformly distributed in the surface of the upper end of the combustion gas generator 1, and the shape and number of the airways matches the shape and number of the grooves, respectively. Six grooves and six airways are alternatively distributed and interconnected. The gas channel 10 is communicated with the chamber and the airway at both ends thereof, and the number thereof is the same as the number of the airway. The bottom of the guiding tube 7 has a '⊥' shape and is placed in the groove. The cover plate 9 is closely fitted with the upper end of the combustion gas generator 1 and the bottom of the guiding tube 7 with the sealing ring 4 in its interface surface. The cover plate 9 is fixed on the upper end of the combustion gas generator 1 with screws. The traction head 6 is placed in the internal bottom end of the guiding tube 7 and is pinned, and is fixed on one corner of the capture net 8 at another end.

The gas generated by the combustion gas generator 1 is the power source of the netting device to push the piston 2 to move so that the guiding tube 7 is rotated 45°, and also to push the traction head 6 to launch outside the guiding tube 7 so that the capture net 8 is smoothly opened. The guiding tube 7 is vertically retracted in the initial state of the netting device. During operating, the ignition signal detonate the igniter 3, the resulting combustion gas pushes the piston 2 to move upward to push the triangle lug on the base of the guiding tube 7, so that the whole guiding tube 7 is rotated. After the piston 2 is moved a distance of 30 mm, the gas channel 10 is opened, so that the gas comes into the guiding tube 7 and pushes the traction head 6 to move at high speed and fly out of the guiding tube 7, so that the traction head 6 drives the capture net 8 to open.

The device has a novel structure and a quick expansion speed, the accelerating tube has a long travel and a large angle, the area of the expansive capture net is big, and the dimensions thereof is small in an initial state.

The invention claimed is:

1. A combustion gas piston type movable guiding tube netting device, comprising: a capture net (8), a traction head (6), a guiding tube (7), an igniter (3), a main gunpowder (5), a sealing ring (4), a combustion gas generator (1), a piston (2) and a cover plate (9); wherein the main gunpowder (5) includes black powders (5-1) and a power box (5-2), the combustion gas generator (1) includes a chamber (1-1), a groove (1-2), an airway (1-3) and a gas channel (10); wherein the chamber (1-1) inside the combustion gas generator (1) has a cylindrical shape, and the piston (2) and the main gunpowder (5) are placed within the chamber (1-1); a top of the piston (2) contacts a triangular lug on the base of the guiding tube (7); a lower end of the combustion gas generator (1) is threadly connected to the igniter (3); the grooves (1-2), the number of which is four to six and the shape of which is semi-cylindrical, are uniformly distributed in a surface of an upper end of the combustion gas generator (1); the shape and number of the airways (1-3) match the shape and number of the grooves (1-2), respectively; a plurality of grooves (1-2) and a plurality of airways (1-3) are interlaced and interconnected; the gas channel (10) is communicated with the chamber (1-1) and the airway (1-3) at both ends thereof, and the number of the gas channels (10) is the same as the number of the airways (1-3); a bottom portion of the guiding tube (7) has a rectangle and is placed in the groove (1-2); the cover plate (9) is closely fitted with the upper end of the combustion gas generator (1) and the bottom portion of the guiding tube (7), and the sealing rings (4) are provided at an interface between the cover plate (9) and the upper end of the combustion gas generator (1), and at an interface between the cover plate (9) and the bottom portion of the guiding tube (7); the cover plate (9) is fixed on the upper end of the combustion gas generator (1) with screws (11); the traction head (6) is placed in the internal bottom end of the guiding tube (7), and is fixed on one corner of the capture net (8) at another end;

the gas generated by the combustion gas generator (1) is the power source of the netting device to push the piston (2) to move so that the guiding tube (7) is rotated 40°-45°, and also to push the traction head (6) to burst out of the guiding tube (7) so that the capture net (8) is smoothly opened; the guiding tube (7) is vertically retracted in the initial state of the netting device; during operating, the ignition signal detonates the igniter (3), the resulting combustion gas pushes the piston (2) to move upward to push the triangle lug on the base of the guiding tube (7) so that the whole guiding tube (7) is rotated; after the piston (2) is moved a distance of 20-40 mm, the gas channel (10) is opened, so that the gas comes into the guiding tube (7) and pushes the traction head (6) to move at high speed and fly out of the guiding tube (7), so that the traction head (6) drives the capture net (8) to open.

* * * * *